US011013350B2

(12) United States Patent
Deshmukh et al.

(10) Patent No.: US 11,013,350 B2
(45) Date of Patent: May 25, 2021

(54) WALL-HANGING ANCHOR PUCK

(71) Applicant: VKRUPA PRODUCTS LLC, Portland, OR (US)

(72) Inventors: Govind Deshmukh, Portland, OR (US); Jeetendra Deshmukh, Portland, OR (US)

(73) Assignee: VKRUPA PRODUCTS LLC, Portland, OR (US)

( * ) Notice: Subject to any disclaimer, the term of this patent is extended or adjusted under 35 U.S.C. 154(b) by 0 days.

(21) Appl. No.: 16/593,903

(22) Filed: Oct. 4, 2019

(65) Prior Publication Data

US 2021/0100376 A1 Apr. 8, 2021

(51) Int. Cl.
*A47G 1/16* (2006.01)

(52) U.S. Cl.
CPC ..... *A47G 1/16* (2013.01)

(58) Field of Classification Search
CPC .... A47G 1/1606; A47G 1/1613; A47G 1/162; A47G 1/1626; A47G 1/1633; A47G 1/164; A47G 1/1666; A47G 1/20; A47G 1/205; A47G 1/16
USPC ..... 248/470, 489, 475.1, 497
See application file for complete search history.

(56) References Cited

U.S. PATENT DOCUMENTS 406,623 A * 7/1889 Brinkerhoff ..... A47G 1/20 248/493
999,961 A * 8/1911 Colas ..... A47G 1/1613 248/498
2,483,114 A * 9/1949 Schoor ..... A47G 1/162 248/496
2,709,056 A * 5/1955 Jacquet ..... A47G 1/162 248/495
2,877,972 A * 3/1959 Sutton ..... A47G 1/1633 248/496
3,337,926 A * 8/1967 Daughtery ..... A47G 1/16 248/489
4,515,338 A * 5/1985 Schneider ..... A47G 1/162 248/460
4,775,129 A * 10/1988 Gleisten ..... A47G 1/162 248/493
7,216,841 B2 * 5/2007 Dodig, Jr. ..... A47G 1/20 248/475.1
9,107,520 B1 * 8/2015 Davies ..... A47G 1/16
(Continued)

FOREIGN PATENT DOCUMENTS

FR 2798571 A1 * 3/2001 ..... A47G 1/142
GB 320376 A * 10/1929 ..... A47G 1/24
WO WO-8802230 A1 * 4/1988 ..... A47G 1/205

*Primary Examiner* — Kimberly T Wood
(74) *Attorney, Agent, or Firm* — Nixon Peabody LLP

(57) ABSTRACT

A wall-hanging anchor has a plurality of mounting holes located at respective peripheral ends of a main body, and has a pluralities of mounts including a sawtooth mount defined in part by adjacent first ends of the front side and the back side, the adjacent first ends being separated by a sawtooth open space configured to receive a sawtooth article. A rope mount is defined in part by adjacent second ends of the front side and the back side, the adjacent second ends being positioned symmetrical to the adjacent first ends relative to a central axis of the main body. A key-hole and D/V-ring swivel mount is defined in part by a movable peg inserted through a central hole located at the central axis of the main body.

14 Claims, 8 Drawing Sheets

(56) References Cited

U.S. PATENT DOCUMENTS

| | | | | |
|---|---|---|---|---|
| 2011/0049325 | A1* | 3/2011 | Johnson | A47G 1/164<br>248/495 |
| 2015/0144756 | A1* | 5/2015 | Miller | A47G 1/1633<br>248/231.91 |
| 2020/0015608 | A1* | 1/2020 | Kaffee | A47G 1/24 |

* cited by examiner

WALL-HANGING ANCHOR PUCK

FIELD OF THE INVENTION

The present invention relates generally to a wall-mounting device, and, more specifically, to a single device for supporting multiple mounting styles.

BACKGROUND OF THE INVENTION

In a home, office, or studio environment, hanging on a wall a picture, frame, or other product is often a challenge. For example, typically, different wall mounts and/or different hanging methods are required for each hanging product. In turn, the different requirements for hanging various products generally translate into frustration and increased expenses associated with the hanging of different hanging product. By way of a specific example, a picture A requires a mount A and a picture B requires a mount B, with mount A being different and requiring a different tool, equipment, and method than mount B.

Thus, there is a need for providing a single, holding device and method that prevents or reduces the above and other problems.

SUMMARY OF THE INVENTION

According to an illustrative embodiment of the present application, a wall-hanging anchor is directed to mounting a variety of artwork articles to a vertical wall surface. The wall-hanging anchor includes a main body having a back side with a flat back surface for direct contact with the vertical wall surface. The main body further has a thickness that separates the back side from a front side, the front side being parallel to the back side. The wall-hanging anchor further includes a plurality of mounting holes located at respective peripheral ends. The plurality of mounting holes may be utilized in a combination of one or more mounting holes, depending on the required load capacity. The wall-hanging anchor further includes a sawtooth mount defined in part by adjacent first ends of the front side and the back side, the adjacent first ends being separated by a sawtooth open space configured to receive a sawtooth article. The sawtooth open space is defined in part by a front surface of the back side sloping internally towards and connecting at a lower end with a back surface of the front side. The wall-hanging anchor further includes a rope mount defined in part by adjacent second ends of the front side and the back side, the adjacent second ends being positioned symmetrical to the adjacent first ends relative to a central axis of the main body. The wall-hanging anchor further includes a swivel mount and a key-hole mount defined in part by a movable peg inserted through a central hole located at the central axis of the main body.

Additional aspects of the disclosure will be apparent to those of ordinary skill in the art in view of the detailed description of various embodiments, which is made with reference to the drawings, a brief description of which is provided below.

Figure 1:
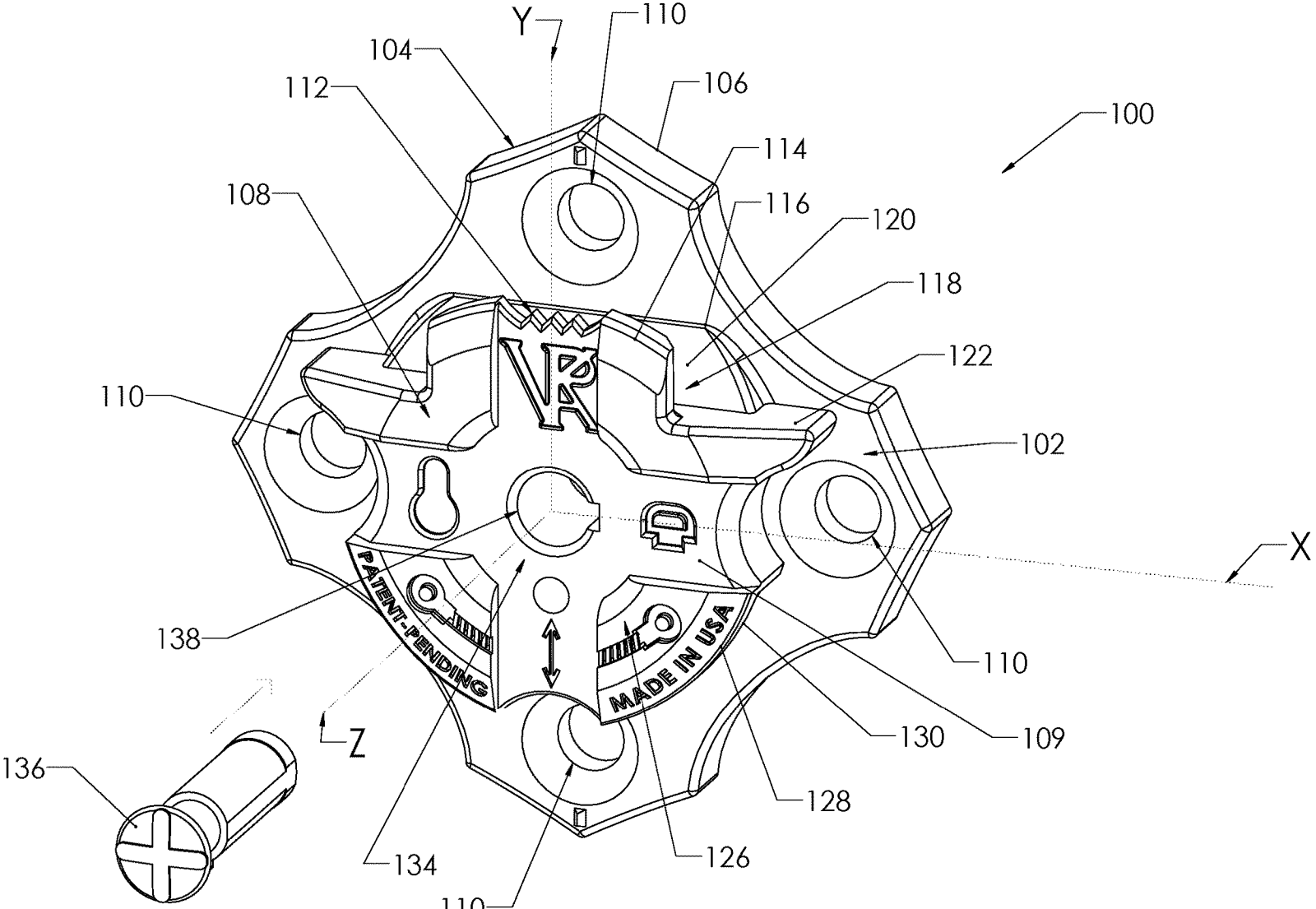
FIG. 1 is a front perspective view of a wall-hanging anchor.
Figure 2:
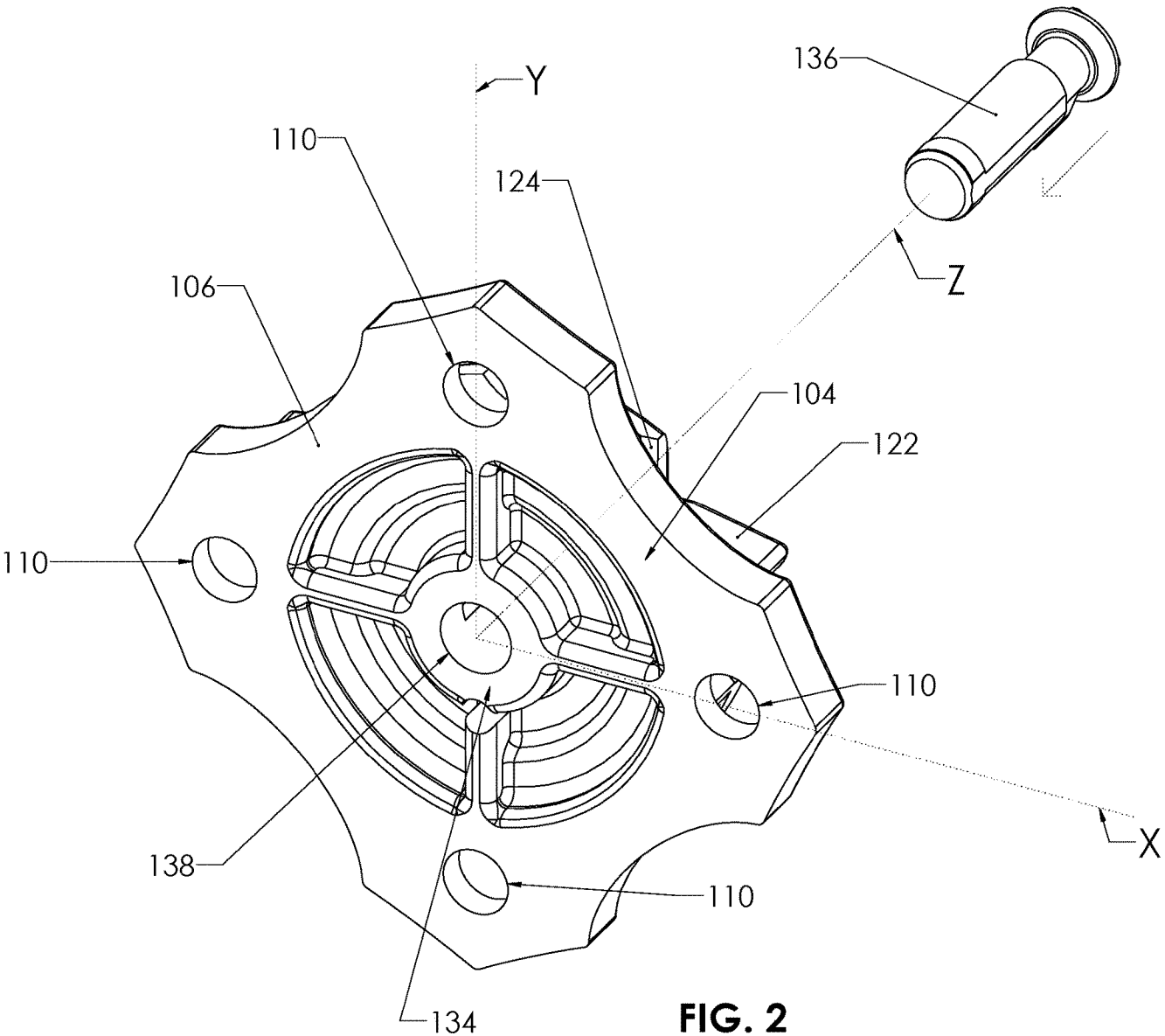
FIG. 2 is a back perspective view of the wall-hanging anchor illustrated in FIG. 1.
Figure 3:
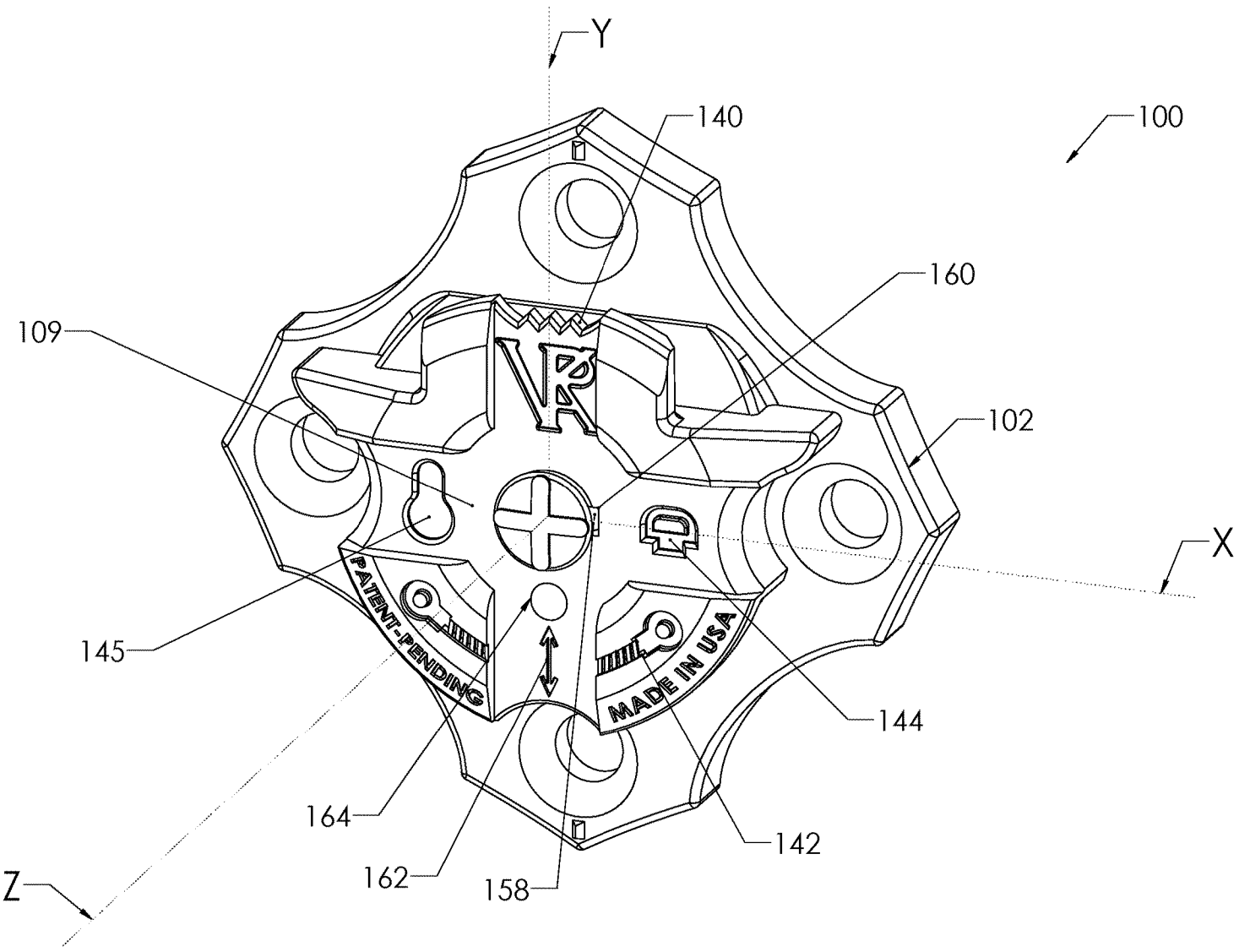
FIG. 3 is a front perspective view of the wall-hanging anchor of FIG. 1 illustrated in a position for hanging of sawtooth mounts.
Figure 4:
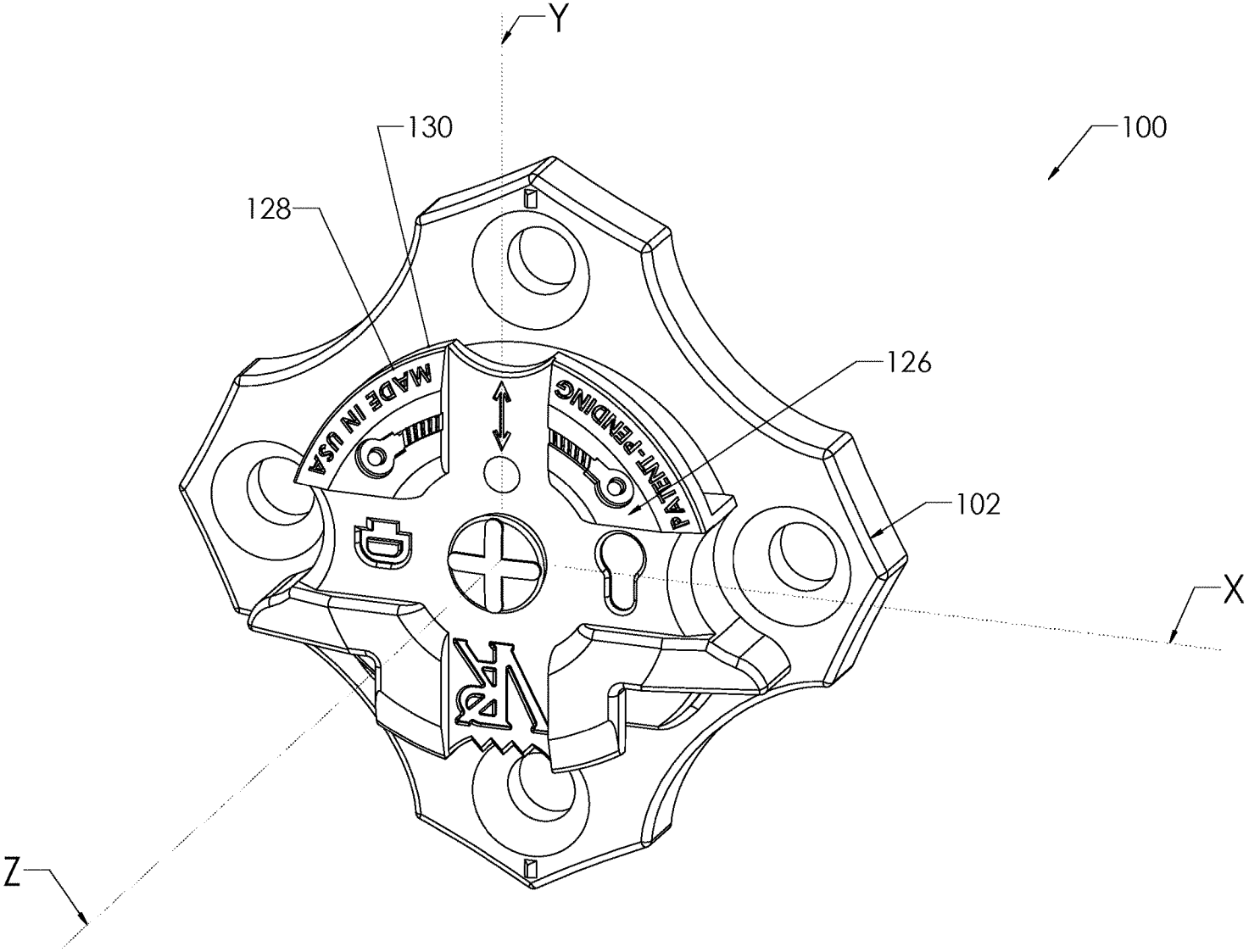
FIG. 4 is a front perspective view of the wall-hanging anchor of FIG. 1 illustrated in a position for hanging of rope or wire mounts.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

A device, referenced herein as wall-banging anchor puck (WAP), is directed to mounting picture frames, posters, and other home/studio articles on a vertical drywall/wood surface. The WAP consolidates major different hanging devices into a single product that can be re-configured to install different styles of hanging products. The WAP contains three distinct surfaces to accommodate mounting of various mounting methods, including: a) a sawtooth mount, b) a rope/wire mount, c) a D-ring or V-ring swivel mount, and d) a key-hole mount. The WAP can be mounted, for example, onto a ½ inch to ¾ inch thick drywall, as ell as directly into a wood stud. The WAP can be utilized for hanging of various loads, for example, to include 20 pounds per device, and if additional loading is required, additional WAP devices may be utilized. In other examples, the WAP can be utilized for other loads.

According to an illustrated embodiment, the WAP is a flat puck-shaped device that can be made of various materials and that includes a plurality of mounting holes. For example, the WAP contains two screw mounting holes of the plurality of mounting holes that are positioned along a Y-axis. In another example, for increased loads, in addition to the Y-axis mounting holes the WAP also contains two screw mounting holes that, are positioned along a X-axis. By way of example, each of the mounting holes receives #6-sized course-threaded drywall screws with a length of about L125 inches.

The WAP can be made of different materials, including, for example, aluminum, zinc, and glass-filled nylon plastic. The WAP has a center tapered hole that houses a partially press-fitted plastic center peg used for mounting of swivel, key-hole, and DIV-ring fixtures.

The WAP is typically installed on a vertical drywall or wood surface. The WAP supports mounting of fixtures with loads that are typical of home-studio environments, when installed on a drywall surface, and has increased load capacity for wood-mounted applications. The WAP accommodates the multiple mount styles described above and includes, for example, accommodating the following features: a) up to ⅛ inch diameter rope/wire for respective mounting applications, and b) 0.05 inch minimum throat depth and ⅝ inch throat length for the sawtooth mount application. For example, the WAP is screwed into the drywall/wood surface using #6-sized coarse-threaded drywall screws. In another example, when the WAP is used for key hole or swivel mount applications, a peg is inserted (partially press/slip-fitted) by the user in the center hole. In yet another example, the WAP is configured to support normal loads by using two screws and higher loads by using four screws.

The size of the WAP is optimized to be of a small-enough size to ensure hanging artwork does not reveal a WAP from surface that faces the viewing angle of the respective hanging product. The WAP has optionally engraved indicators (as illustrations for the user) of the type of mount associated with the orientation of the WAP on the wall (e.g. the respective hanging method is shown facing up). The thickness of the WAP is minimized to ensure the hanging artwork is hung as close to the wall as possible.

Referring to a specific illustrative embodiment, the WAP is capable of supporting five various mounting styles:

1. frames with sawtooth mount up to a throat depth of 0.05 inch×1.625-1.75 inches long;
2. roped frames, with a maximum capacity of ⅛ inch diameter rope;
3. wired frames with a maximum capacity of ⅛ inch diameter rope;
4. frames with swivel D-ring or V-ring mount; and
5. key-holed products.

The WAP of this specific illustrative embodiment is capable to withstand normal home, studio, or museum weights. For heavier loads and fixtures that contain multiple mounting styles, two or more WAPs are suggested. The WAP is positioned with respect to stud or no-stud areas and has a transparent-to-wall thickness that minimizes or completely obscures the WAP from view when hanging product is hanged on the WAP. The WAP has no loose parts (once the center peg is inserted) except for mounting hardware and is aesthetically designed with self-explanatory symbols of each mounting style. The WAP is versatile in hanging different hanging products and provides a uniform look on the respective wall. In addition to the mounting holes, the WAP contains a #4-sized screw hole on its Y-axis for the user to mount, at the user's discretion, other fixtures not mentioned above.

The WAP of the specific illustrative embodiment is packaged with a puck portion and a center peg that is inserted in a center hole. Four #6-sized course-threaded drywall screws are provided. Tools recommended, not provided, include a hard leaded pencil or sharp scribe, a power drill with philips screw head or a hand screwdriver with a philips screw head, a bubble level, and a hammer or mallet.

Precautions prior to installation include firm and secured installation of mounting hardware on the frames, and mounting hardware square with a respective frame. Tilted mounting hardware can cause non-vertical frames on the wall. The WAP is packaged with mounting instructions to be followed by the user.

Referring generally to FIGS. 1-7, a wall-hanging anchor 100 (also referred to as a WAP) is directed to mounting a variety of artwork articles to a vertical wall surface. The wall-hanging anchor 100 includes a main body 102 having a back side 104 with a flat back surface 106 for direct contact with the vertical wall surface. The main body 102 further has a thickness that separates the back side 104 from a front side 108, the front side 108 being parallel to the back side 104 and having a front surface 109.

The wall-hanging anchor 100 further includes a plurality of mounting holes 110 located at respective peripheral ends of the main body 102. The wall-hanging anchor 100 further includes a sawtooth mount 112 defined in part by adjacent first ends 114, 116 of the front side 108 and the back side 104, the adjacent first ends 114, 116 being separated by a sawtooth open space 118 configured to receive a sawtooth article. The sawtooth open space 118 is defined in part by a front surface 120 of the back side 104 sloping at least in part internally towards and connecting at a lower end 122 with a back surface 124 (shown more clearly in FIG. 2) of the front side 108.

The wall-hanging anchor 100 further includes a rope mount 126 defined in part by adjacent second ends 128, 130 (shown more clearly in FIG. 4) of the front side 108 and the back side 104, the adjacent second ends 128, 130 being positioned symmetrical to the adjacent first ends 114, 116 relative to a central Z axis of the main body 104. The wall-hanging anchor 100 further includes a swivel/key-hole mount 134 defined in part by a movable peg 136 inserted through a central hole 138 located at a central point of the main body 104 where X, Y, and Z axes are intersecting. As illustrated more clearly in FIGS. 5 and 6, a key-hole fixture 132 or a swivel D-ring fixture 133 are mountable to hang from the peg 136.

The wall-hanging anchor 100 includes one or more engraved illustrations having a graphical symbol indicative of a respective type of mount. For example, one of the engraved illustrations has a sawtooth graphical symbol 140 that is indicative of a sawtooth mount, one of the engraved illustrations has a rope graphical symbol 142 indicative of a rope mount, one of the engraved illustrations has a swivel graphical symbol 144 indicative of a swivel mount, and one of the engraved illustrations has a key-hole graphical symbol 145 indicative of a key-hole mount.

Optionally, the plurality of mounting holes 110 includes a pattern of two mounting hole symmetrically positioned around the central axis of the main body 104. Optionally, yet, the plurality of mounting holes 110 includes a pattern of four mounting hole symmetrically positioned around the central axis of the main body 104. The mounting holes 110, according to one example, are positioned along a bolt circle diameter of about 1.36 inches.

According to another optional feature, the movable peg 136 has a front end 146 near a neck section 148 that is unitary with a main section 150. The main section 150 has near a back end 152 of the peg 136 a press-fit section 154 that has a slightly larger outer diameter than the main section 150. Upon insertion of the peg 136 into the central hole 138, the press-fit section 154 meets initial resistance from frictional contact with peripheral material of the main body 102 defining the central hole 138. The peg 136 is forced or pressed-fit within the central hole 138 such that the press-fit section 154 is inserted pass the back side 104 of the main body 102. At this point, the peg 136 is easily rotatable or swivel-able within the central hole 138.

According to yet another optional feature, a front side 156 of the front end 146 has a diameter of about 0.250 inch, and the central hole 138 has a diameter of about 0.191 inch. Optionally, yet, the main section 136 has a diameter of about 0.186 inch and the neck section 152 has a diameter of about 0.145 inch.

According to an optional configuration, the thickness of the main body is about 0.405 inch as defined by a distance separating the back surface 106 of the back side 104 from a front surface 156 of the front side 108. According to another optional configuration, the front surface 120 of the back side 104 is separated from the back surface 106 of the back side by a distance of about 0.155 inch.

Figure 5:
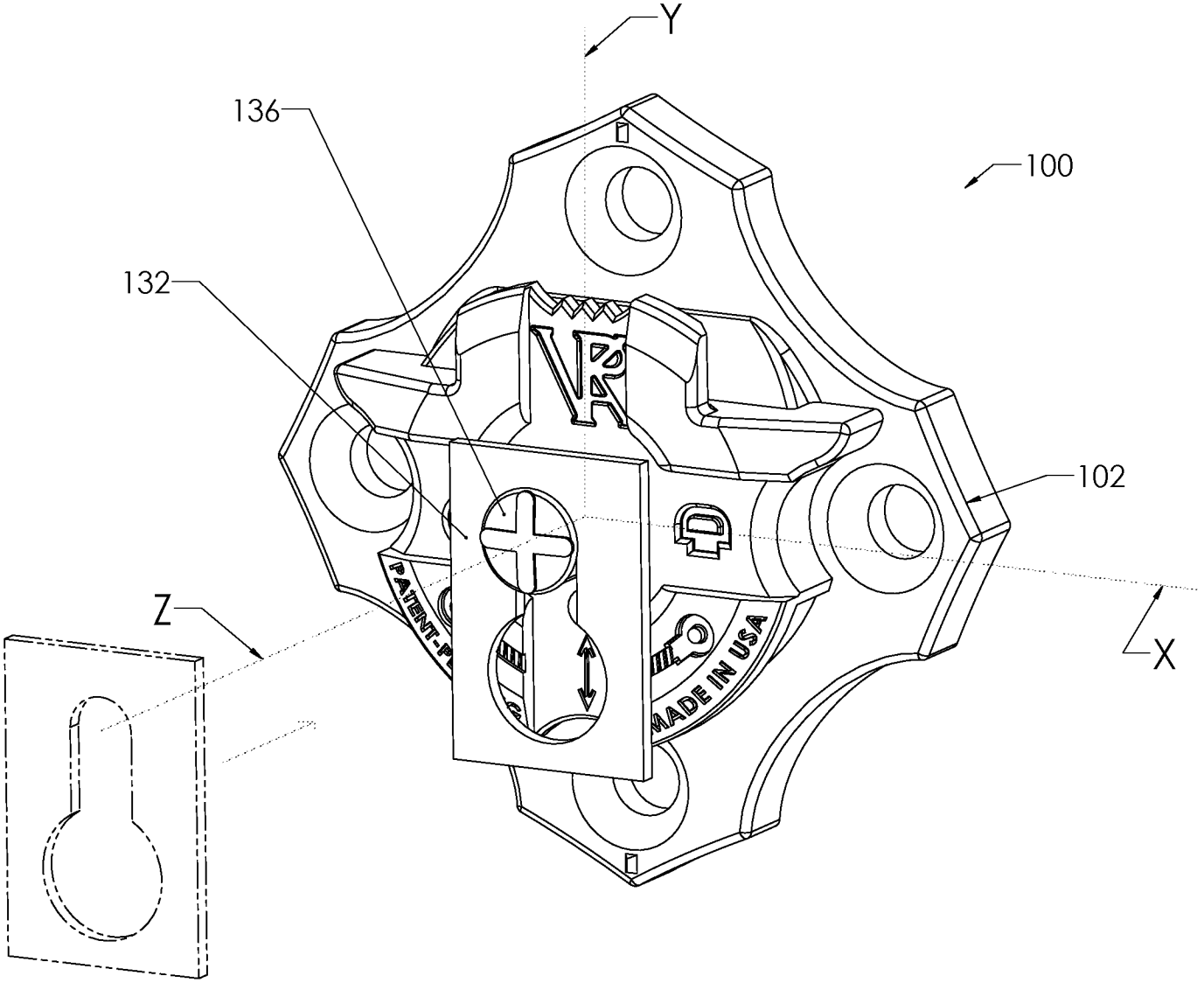
FIG. 5 is a front perspective view of the wall-hanging anchor of FIG. 1 illustrating a key-hole mount.
Figure 6:
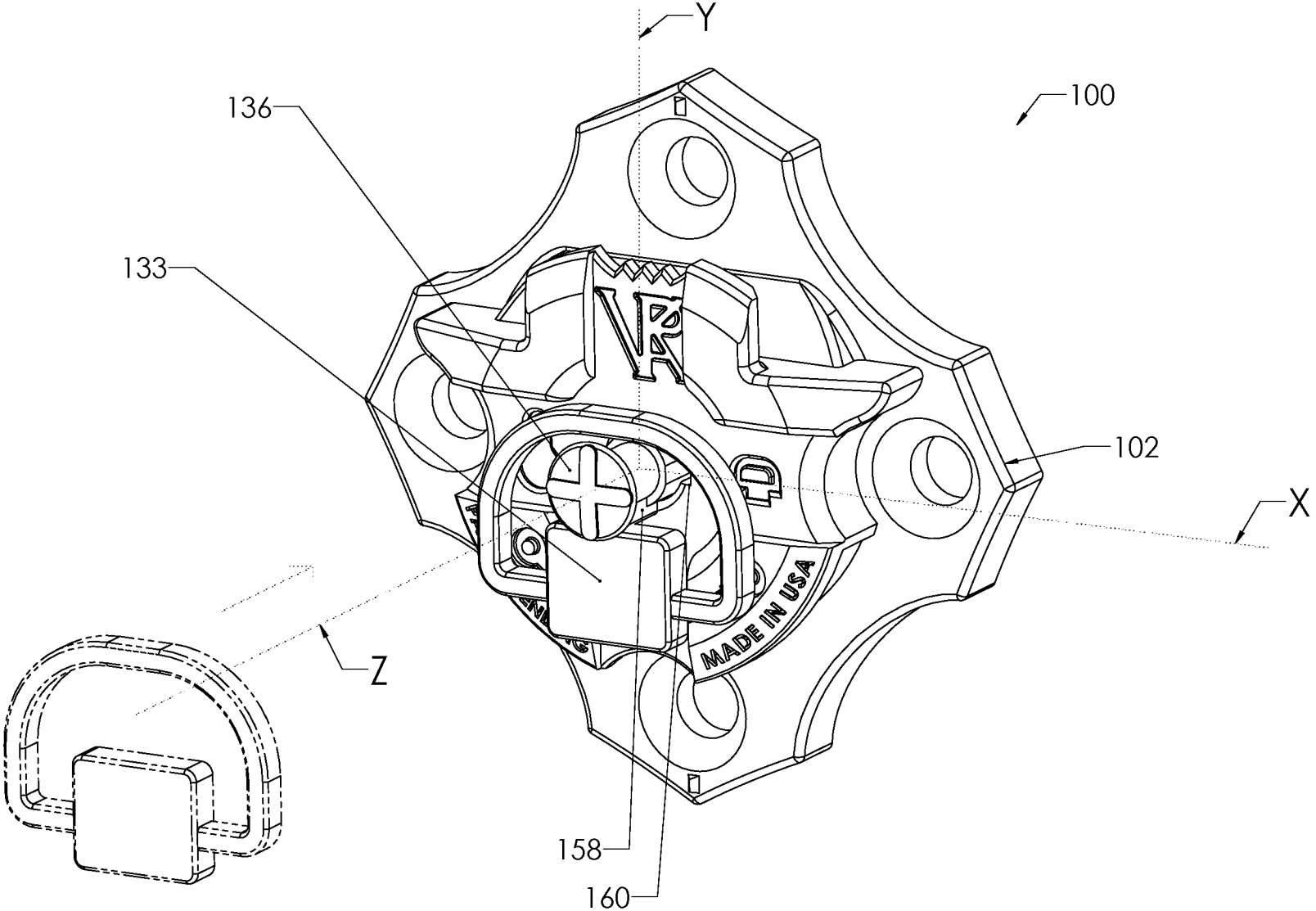
FIG. 6 is a front perspective view of the wall-hanging anchor of FIG. 1 illustrating a swivel mount.

According to yet another optional configuration, the peg 136 has a key 158 that is aligned with a slot 160 (referenced in FIGS. 3 and 6) of the central hole 138. For example, to assemble the peg 136 with the WAP 100, a user aligns the slot 160 of the central hole 138 with the key 158 of the peg 136 and initially presses the peg 136 within the central hole 138. After the press-fit section 154 near the back end 152 of the peg 136 is forced into the central hole 138 past the back surface 106, the peg 136 is free to oscillate within the WAP 100. Typically, the peg 136 is in a home position when the front end 146 is generally flush with front side 108 of the main body 102. To mount any fixture or object on the peg 136, the peg 136 is pulled out from its home position until the key 158 clears the front surface 109 of the front side 108. Then, the peg 136 is rotated such that the key 158 locks in load position of the peg 136. To place the peg 136 back to the home position, the peg 136 is rotated until the key 158 is again aligned with the slot 160 and, then, pushed within the central hole 138. In the load position, the peg 158 facilitates hanging of key-hole fixtures 132 (as illustrated in FIG. 5) or swivel D/V-ring fixtures (as illustrated in FIG. 6).

Figure 7:
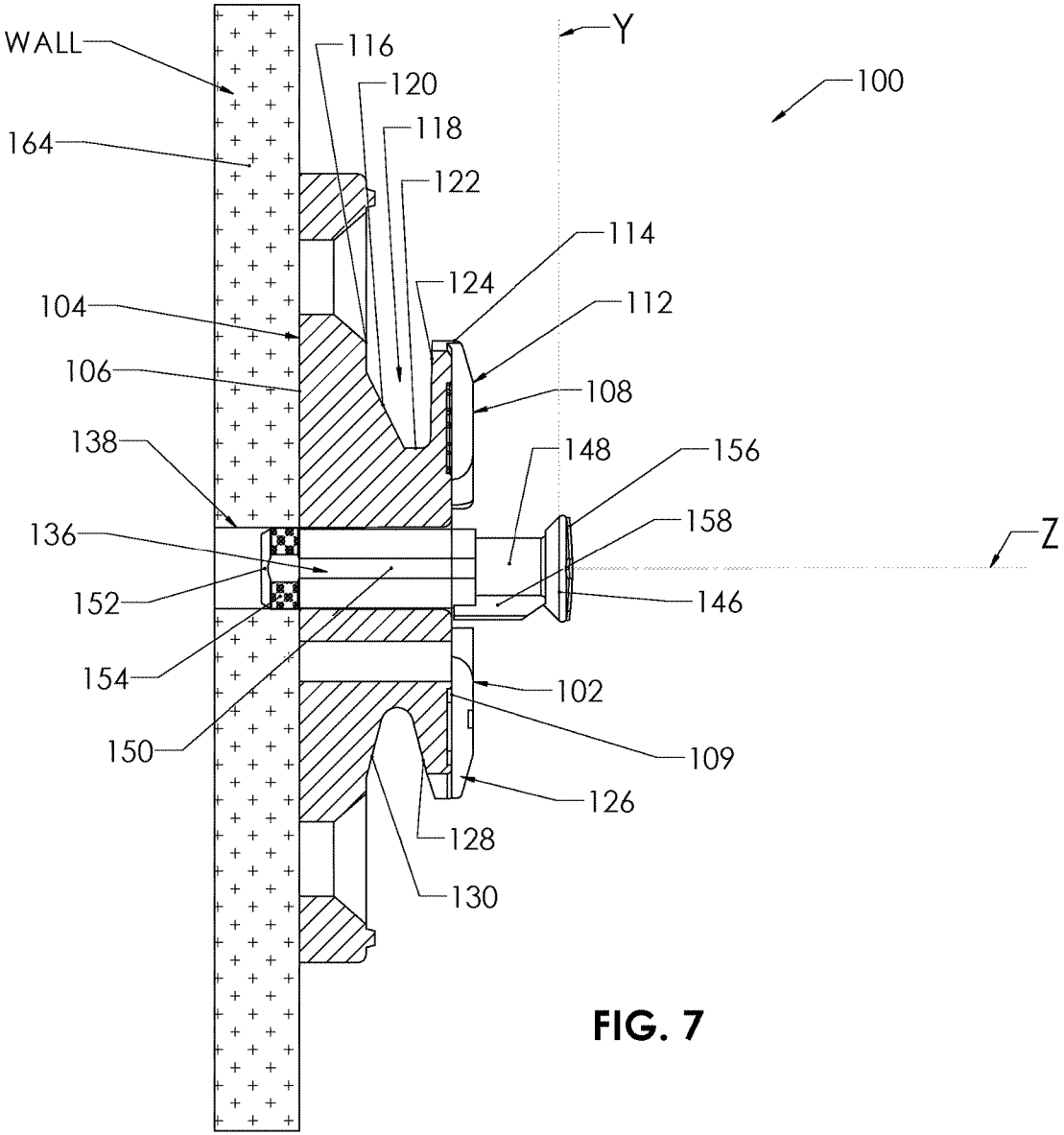
FIG. 7 is a side cross-sectional view illustrating the wall-hanging anchor of FIG. 1 mounted to a vertical wall in the position for hanging of sawtooth mounts.
Figure 8:
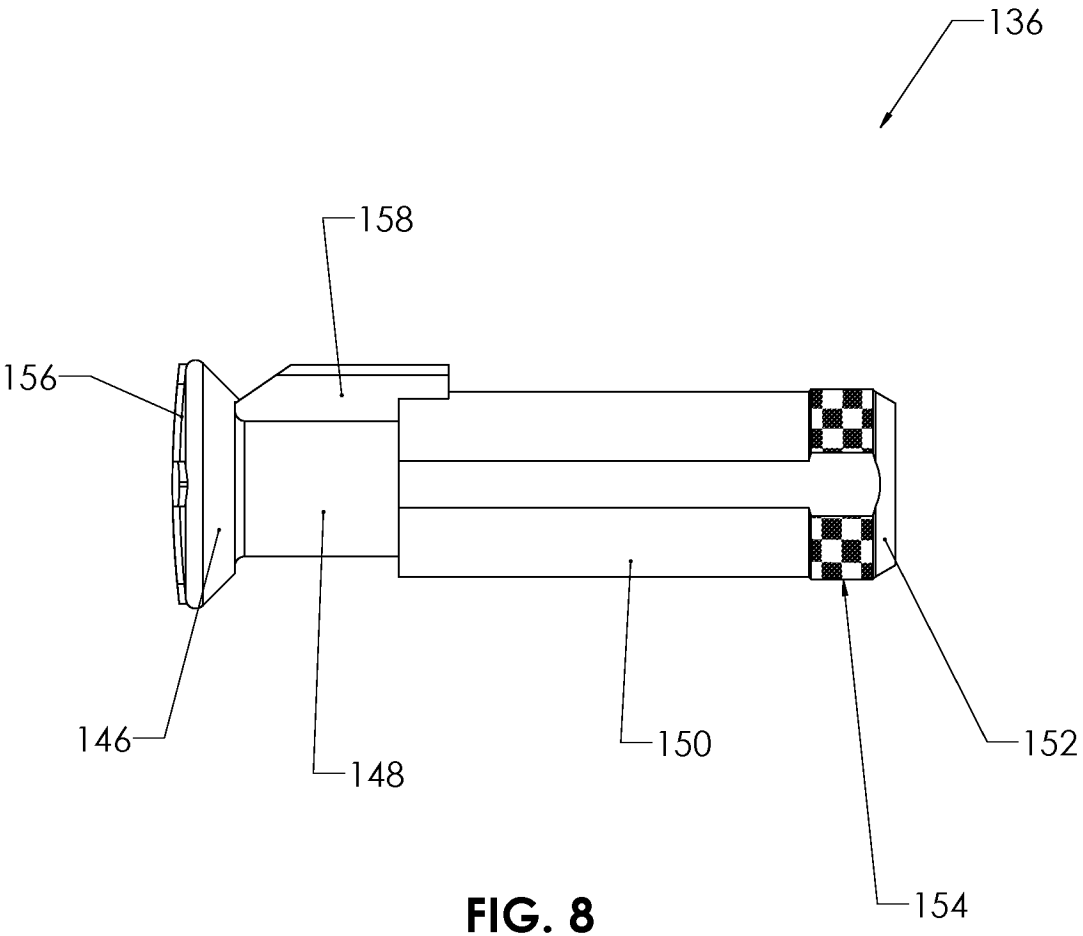
FIG. 8 is a side view illustrating a peg for the wall-hanging anchor of FIG. 1.

According to yet another optional configuration, the main body 102 further includes on the front surface 109 a mounting position indicator 162 (referenced in FIG. 3) for facilitating vertical mounting of the WAP 100 to a wall surface 164 (referenced in FIG. 7). For example, the mounting position indicator 162 is a level bubble indicator, a free-swinging pendulum indicator, and/or an electronic indicator. The mounting position indicator 162 serves as a visible guide, obviating the need for a user to manually align the WAP 100 to pre-scribed vertical lines.

According to yet another optional configuration, the main body 102 further includes a secondary hole 164 (referenced in FIG. 3) positioned along the Y axis for mounting other fixtures at a user's discretion. The secondary hole 164 is additional to the mounting holes 110 and, according to one example, is a #4-sized screw hole.

It will be evident to those skilled in the art that the invention is not limited to the details of the foregoing illustrated embodiment and that the present invention may be embodied in other specific forms without departing from the spirit or essential attributes thereof. For example, the present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A wall-hanging anchor for mounting a variety of artwork articles to a vertical wall surface, the wall-hanging anchor comprising:

a main body having a back side with a flat back surface for direct contact with the vertical wall surface, the main body further having a thickness that separates the back side from a front side, the front side being parallel to the back side;

a plurality of mounting holes located at respective peripheral ends of the main body;

a sawtooth mount defined in part by adjacent first ends of the front side and the back side, the adjacent first ends being separated by a sawtooth open space configured to receive a sawtooth article, the sawtooth open space being defined in part by a front surface of the back side sloping internally towards and connecting at a lower end with a back surface of the front side;

a rope mount defined in part by adjacent second ends of the front side and the back side, the adjacent second ends being positioned symmetrical to the adjacent first ends relative to a central axis of the main body; and a key-hole, a D-ring, or a V-ring swivel mount defined in part by a movable peg inserted through a central hole located at the central axis of the main body.

2. The wall-hanging anchor of claim 1, further comprising one or more engraved illustrations having a graphical symbol indicative of a type of mount.

3. The wall-hanging anchor of claim 2, wherein one of the one or more engraved illustrations has a sawtooth graphical symbol, and the type of mount is the sawtooth mount.

4. The wall-hanging anchor of claim 2, wherein one of the one or more engraved illustrations has a rope graphical symbol, and the type of mount is rope mount.

5. The wall-hanging anchor of claim 2, wherein one of the one or more engraved illustrations has a key-hole, a D-ring, or a V-ring swivel graphical symbol, and the type of mount is the swivel mount.

6. The wall-hanging anchor of claim 1, wherein the plurality of mounting holes includes a pattern of two mounting holes symmetrically positioned around the central axis of the main body.

7. The wall-hanging anchor of claim 1, wherein the plurality of mounting holes includes a pattern of four mounting holes symmetrically positioned around the central axis of the main body.

8. The wall-hanging anchor of claim 1, wherein the movable peg includes a main peg section that is inserted at a back end through the central hole.

9. The wall-hanging anchor of claim 8, wherein the front disk-shaped side has a diameter of 0.250 inch, the central hole has a diameter of 0.191 inch, and the main peg section has a diameter of 0.186 inch.

10. The wall-hanging anchor of claim 1, wherein the plurality of mounting holes are positioned along a bolt circle diameter of 1.36 inches.

11. The wall-hanging anchor of claim 1, wherein the thickness of the main body is 0.405 inch as defined by a distance separating the back surface of the back side from a front surface of the front side.

12. The wall-hanging anchor of claim 1, wherein the front surface of the back side is separated from the back surface of the back side by a distance of 0.155 inch.

13. The wall-hanging anchor of claim 1, wherein the front surface integrates at least one mounting position indicator for facilitating vertical mounting of the wall-hanging anchor to a wall surface.

14. The wall-hanging anchor of claim 13, wherein the at least one mounting position indicator includes one or more of a level bubble indicator, a free-swinging pendulum indicator, and an electronic indicator.

* * * * *